United States Patent [19]

Van Daelen

[11] Patent Number: 4,721,882

[45] Date of Patent: Jan. 26, 1988

[54] CATHODE RAY TUBE

[75] Inventor: Henri J. G. M. Van Daelen, Eindhoven, Netherlands

[73] Assignee: U.S. Philips Corporation, New York, N.Y.

[21] Appl. No.: 610,172

[22] Filed: May 14, 1984

Related U.S. Application Data

[63] Continuation of Ser. No. 310,668, Oct. 13, 1981, abandoned.

[30] Foreign Application Priority Data

Nov. 10, 1980 [NL] Netherlands ..... 8006123

[51] Int. Cl.[4] ..... H01J 31/00

[52] U.S. Cl. ..... 313/481; 313/482; 313/558; 313/559; 313/561

[58] Field of Search ..... 313/481, 482, 553, 558, 313/559, 561

[56] References Cited

U.S. PATENT DOCUMENTS 3,197,546 7/1965 Hopper ..... 313/561

4,276,494 6/1981 van Roosmalen et al. ..... 313/482

*Primary Examiner*—William L. Sikes

*Assistant Examiner*—Robert E. Wise

*Attorney, Agent, or Firm*—Robert J. Kraus

[57] ABSTRACT

A television camera tube including a getter (23,24) is assembled so as to be thermally independent of an electron gun (4) and may be provided with any desired electric potential. The getter (23,24) is positioned in a tubular envelope portion (1) of the tube by means of a supporting member (12,21,25) which rests on a supporting edge (11) in the envelope (1). The supporting edge is formed by a stepped reduction of the internal transverse dimension of the envelope portion (1). The supporting member (12) comprises an inner ring (16) which is connected to an outer ring (15) in a limited number of places (19). In the circumferential direction the inner ring (16) and the outer ring (15) include an interruption (17) to counteract excessive heating of the rings during inductive heating of the getter (23,24). Metal strips (21) which support the getter (23,24) are connected to the inner ring (16). The supporting structure is well suited for use in comparatively small cathode ray tubes.

4 Claims, 4 Drawing Figures

CATHODE RAY TUBE

This is a continuation of application Ser. No. 310,668, filed Oct. 13, 1981, now abandoned.

BACKGROUND OF THE INVENTION

The invention relates to a cathode ray tube comprising an evacuated glass envelope having a tubular envelope portion, within which envelope portion means to generate an electron beam and an annular metal getter holder are accommodated.

Such a cathode ray tube, in this case a television camera tube, is known from U.S. Pat. No. 3,783,326. The getter holder of the tube described therein is connected to the electron gun, so that the getter holder during operation of the tube has the same electric potential as the last electrode of the electron gun. The connection of the getter holder to the electron gun has the further disadvantage that during inductive heating of the getter (getter holder with contents) parts of the gun are also heated, for example, by inductive stray fields or via thermal conductivity from the getter to the gun.

SUMMARY OF THE INVENTION

It is an object of the invention to provide a cathode ray tube in which the getter holder is assembled in a tubular envelope portion of the tube so as to be thermally independent of the electron gun and can be provided with any desired electric potential.

According to the present invention a cathode ray tube comprising an evacuated glass envelope having a tubular envelope portion, within which envelope portion means to generate an electron beam and an annular metal getter holder are accommodated, is characterized in that the getter holder is positioned in the tubular envelope portion by means of a supporting member which rests on a supporting edge. The supporting edge is formed by a substantially stepped reduction of the internal transverse dimension of the tubular envelope portion.

The advantage of such a construction is that the getter holder is assembled in the tubular envelope portion so as to be mechanically and thermally independent of the electron gun. In such a construction, the getter can be inductively heated rapidly and effectively. When a non-evaporating getter is used, inductive heating is necessary to activate the gettering material provided in the getter holder. When an evaporating getter is used, such heating is necessary to evaporate the gettering material from the getter holder.

According to an embodiment of the invention, the supporting member consists at least substantially of a discontinuous ring. Due to a discontinuity in the ring, excessive heating of the ring during the inductive heating of the getter is prevented. Excessive heating of the annular supporting member may be undesirable due to the direct contact thereof with the glass tube envelope.

According to a further embodiment of the invention the supporting member comprises a discontinuous inner ring and a discontinuous outer ring, the inner ring supporting the getter holder and being connected to the outer ring in a limited number of places along its circumference, the outer ring bearing on the supporting edge formed in the tubular envelope portion. By connecting the inner ring to the outer ring in a limited number of places, the heat transfer via conduction from the getter to the outer ring is restricted. Heat transfer via conduction can be further restricted by means of a construction in which the inner ring of the supporting member has axially extending strips, which strips support the getter holder.

In the case of a non-rotationally symmetrical supporting construction, disturbances of the electric field lines in the tube may occur. Electron-optically, such disturbances may lead to undesired effects. In order to restrict such field disturbances, according to the invention, the getter holder may be placed between two axially spaced rings, which rings during operation of the tube are at the same electric potential, so that the getter holder is situated in a substantially field-free space. In the construction according to the invention the annular supporting member may form a first of these two rings, while the strips which support the getter holder extend beyond the getter holder and terminate in a plate-shaped discontinuous ring which forms the second of the two rings.

The overall supporting structure for the getter holder can be simply manufactured from sheet material and is well suited for mass production.

BRIEF DESCRIPTION OF THE DRAWING

An embodiment of the invention will now be described in greater detail, by way of example, with reference to the accompanying drawing, of which.

DESCRIPTION OF THE PREFERRED EMBODIMENTS

Figure 1:
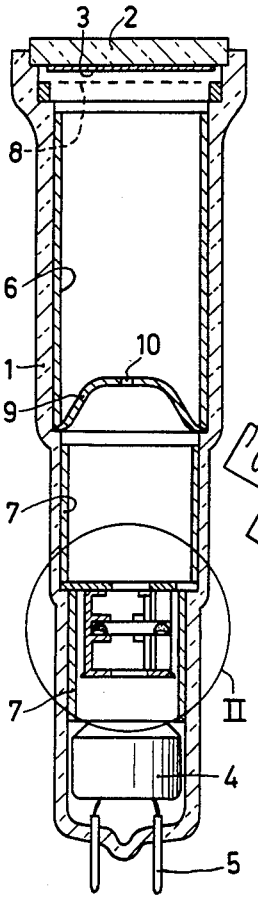
FIG. 1 is a diagrammatic sectional view of a television camera tube in which a getter according to the invention is mounted.

The television camera tube shown in FIG. 1, in which details which are not essential for the understanding of the invention are not shown, comprises a glass envelope 1 which is sealed at one end by means of a glass window 2 having a photosensitive layer 3. An electron gun 4 is provided in the tube, to which gun the desired electric voltages can be supplied via a number of leadthrough pins 5. The inner wall of the envelope 1 is covered with a thin layer of nickel forming a first wall electrode 6 and a second wall electrode 7 to focus the electron beam generated by the electron gun 4. The tube further comprises a mesh electrode 8 and a diaphragm 9 having an aperture 10 through which the electron beam passes before landing on the photosensitive layer 3. The window 2, the mesh electrode 8 and the diaphragm 9 each rest on supporting edges which are provided in the inner wall of the envelope and which have been formed by a stepped reduction of the inside diameter of the tube. The supporting edges are obtained by vacuum deforming and pressing a glass tube on a profiled metal mandril at a temperature at which the glass is somewhat soft so that the inner wall of the glass tube is profiled in accordance with the shape of the mandril. In this manner the envelope 1 is produced with inside dimensions which are extremely accurate both in the radial and in the axial direction. A tube obtained in this manner and having supporting surfaces for the window and certain electrodes is disclosed in Netherlands patent application No. 7807756, corresponding to U.S. Pat. No. 4,304,586.

In the case of a cathode ray tube of comparatively small dimensions, such as a television camera tube, it is difficult to accommodate a getter in the tube without causing the above-mentioned problem relating to disturbance of the electric field lines in the tube, inductive heating of the getter, and the connection of the getter in the tube.

Figure 2:
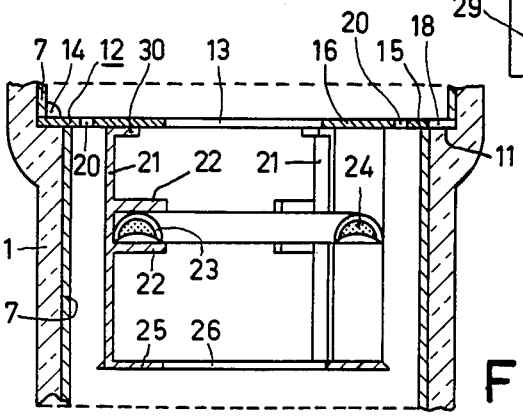
FIG. 2 shows a detail of the tube shown in FIG. 1.

An embodiment of a structure to support the getter in the tube which avoids these problems is shown in FIGS. 1 and 2. The getter supporting structure in the tube shown in FIG. 1 is shown in detail in FIG. 2. An extra supporting edge 11 in the inner wall of the envelope 1 has been obtained by vacuum deforming a calibrated glass tube onto a profiled mandril. A supporting member 12 in the form of a ring having a central aperture 13 rests on the supporting edge. The supporting member 12 is connected to the wall electrode 7 by means of indium balls 14 and comprises an outer ring 15 and an inner ring 16, as is shown in detail in FIG. 3 which is a plan view of the supporting member 12. The annular supporting member 12 has a discontinuity 17. The outer ring 15 has three projecting supporting surfaces 18 which rest on the supporting edge 11. Further, the inner ring 16 is separated from the outer ring 15 by a slot 20 and is connected to the outer ring 15 only in a limited number of places 19 situated between the supporting surfaces 18. The supporting member 12 is manufactured from sheet material. A number of strips 21 (FIG. 2) extending in the axial direction are welded to the inner ring 16. The strips 21 have radially extending projections 22 between which a getter holder 23 is fixed. The getter holder 23 consists of an annular metal channel in which an evaporable gettering material in the form of a powder mixture 24 of barium-aluminum ($BaAl_4$) and nickel in the weight ratio of approximately 1:1 has been compressed. The barium is evaporated from the powder mixture 24 by inductive heating and is deposited as a thin layer of gettering metal on internal surface parts of the tube. In the arrangement of the getter holder 23 shown in FIGS. 1 and 2, the barium evaporates in the direction of the electron gun 4 so that no barium can deposit on the photosensitive layer 3. During inductive heating of the getter holder 23 and the gettering material 24, the supporting structure of the getter holder should not be heated excessively, in particular not in those places where the supporting structure contacts the glass wall of the envelope 1. The measures taken for that purpose may be recognized in FIG. 3. Direct heating of the supporting member 12 by inductive currents is mainly counteracted by giving the inner ring 16 and the outer ring 15 discontinuities 17. Heat transfer by conduction from getter (23, 24) to the outer ring 15, in particular to the supporting surfaces 18, is counteracted as much as possible by creating a long thermal path and a large thermal resistance between getter holder 23 and supporting surfaces 18. This is accomplished by limiting the number of connection places 19 between the inner ring 16 and the outer ring 15 and by situating these places between the supporting surfaces 18.

Figure 4:
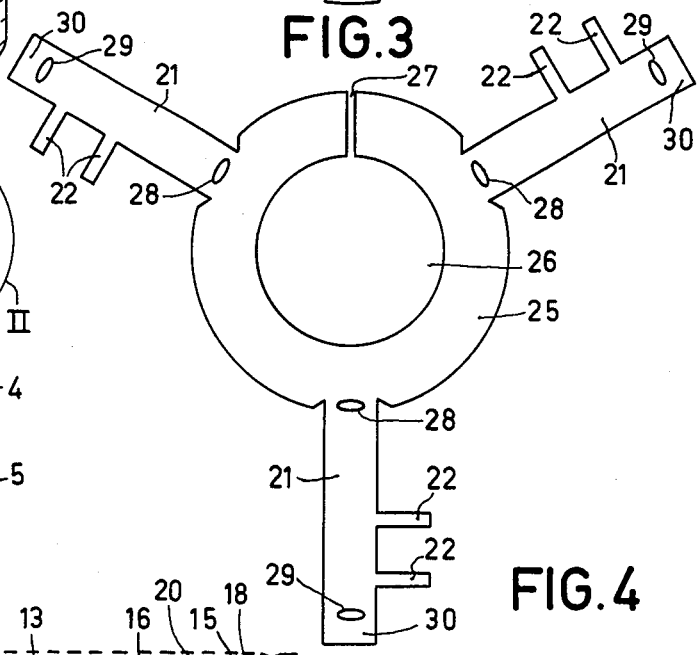
FIG. 4 shows another part of the supporting structure shown in FIG. 2.

Disturbances of the electric field lines in the tube are minimized by placing the getter with its supporting structure in a substantially field-free space, if possible. In the present case the getter with its supporting structure is placed approximately mid-way along the wall electrode 7 and is electrically-connected thereto. Further means for obtaining the desired variation of the field lines have been realized by a plate-shaped ring 25 having a central aperture 26. The ring 25 is connected to the metal strips 21. FIG. 4 is a developed view of the ring 25 manufactured from sheet material and the strips 21 and projections 22 formed integral therewith. For the already mentioned reasons the ring 25 also has a discontinuity 27. The elongate apertures 28 and 29 in the strips 21 serve to locate predefined bending places.

Figure 3:
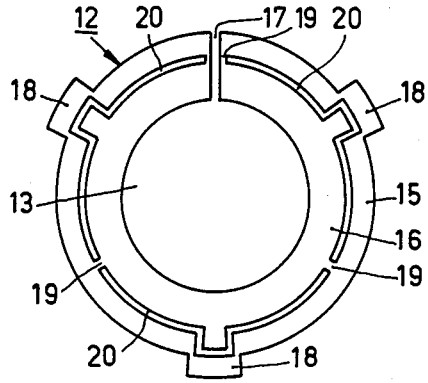
FIG. 3 shows a part of the supporting structure for the getter shown in FIG. 2.

Although the invention has been explained with reference to one embodiment, it is not restricted thereto. For example, it is also possible to connect the getter (23,24) in the tube by means of the structure shown in FIG. 4 alone. In that case the strips 21 are bent radially outward near the apertures 29 so that supporting surfaces 30 are obtained which rest on the supporting edge 11. In this case, the supporting member 12 shown in FIG. 3 is not necessary. Electron-optically, however, the supporting structure shown in FIG. 2 satisfies stringent requirements, because the getter (23,24) is situated between two rings 12 and 25 which are at the same electric potential.

What is claimed is:

1. A cathode ray tube comprising an evacuated glass envelope having a tubular envelope portion containing an electron gun, an annular metallic getter holder positioned to enable an axially-directed electron beam produced by the gun to pass therethrough, and an arrangement for mounting said getter holder in the tube such that it is mechanically, electrically and thermally isolated from the gun, said arrangement comprising;

a. a step-shaped surface formed on the inner periphery of the tubular envelope portion, b. an annular, metallic supporting member having a peripheral portion thereof resting on the step-shaped surface and having a radially-directed discontinuity for minimizing induced current in the member during inductive heating of the getter holder, said member being positioned to enable the electron beam to pass therethrough; and c. a plurality of metallic axially-directed arms extending from the supporting member to the getter holder for supporting said getter holder in the tube.

2. A cathode ray tube as in claim 1 where the supporting member comprises inner and outer disc-shaped rings having respective, radially-directed discontinuities which cooperate to form said radially-directed discontinuity of the supporting member, said rings being connected to each other at a plurality of places along the circumference thereof, said axially-directed arms extending from said inner ring.

3. A cathode ray tube as in claim 1 or 2 where the arms include respective portions extending beyond the getter holder, and where the arrangement for mounting the getter holder includes a metallic, disc-shaped ring supported by said respective portions of said arms and positioned to enable the electron beam to pass therethrough.

4. A cathode ray tube as in claim 3 where the disc-shaped ring supported by the portions of the arms extending beyond the getter holder includes a radially-directed discontinuity for minimizing induced current in said ring during inductive heating of the getter holder.

* * * * *